US010688633B2

(12) United States Patent
Lee

(10) Patent No.: US 10,688,633 B2
(45) Date of Patent: Jun. 23, 2020

(54) FABRICATION METHOD OF A HOLDING SLEEVE

(71) Applicant: Tien-I Industrial Co., Ltd., Taichung (TW)

(72) Inventor: Larry Lee, Taichung (TW)

(73) Assignee: TIEN-I INDUSTRIAL CO., LTD., Taichung (TW)

( * ) Notice: Subject to any disclaimer, the term of this patent is extended or adjusted under 35 U.S.C. 154(b) by 155 days.

(21) Appl. No.: 16/121,022

(22) Filed: Sep. 4, 2018

(65) Prior Publication Data

US 2018/0369999 A1 Dec. 27, 2018

Related U.S. Application Data

(63) Continuation-in-part of application No. 14/806,396, filed on Jul. 22, 2015, now abandoned, which is a continuation-in-part of application No. 13/630,061, filed on Sep. 28, 2012, now abandoned.

(51) Int. Cl.

| | |
|---|---|
| ***B25B 23/00*** | (2006.01) |
| ***B25G 1/04*** | (2006.01) |
| ***B25G 1/06*** | (2006.01) |
| *B25B 13/46* | (2006.01) |
| *B25B 13/06* | (2006.01) |

(52) U.S. Cl.

CPC ..... *B25B 23/0042* (2013.01); *B25B 23/00* (2013.01); *B25G 1/043* (2013.01); *B25G 1/063* (2013.01); *B25B 13/06* (2013.01); *B25B 13/46* (2013.01); *Y10T 29/4984* (2015.01); *Y10T 279/17811* (2015.01)

(58) Field of Classification Search

CPC . B25B 23/0021; B25B 21/0042; B25B 15/02; B25G 1/06; B25G 3/20; B25G 1/063

See application file for complete search history.

(56) References Cited

U.S. PATENT DOCUMENTS

| | | | | |
|---|---|---|---|---|
| 2,963,930 A | | 12/1960 | Clothier et al. | |
| 4,586,406 A | * | 5/1986 | Howard | B25G 1/043 16/429 |
| 6,089,133 A | | 7/2000 | Liao | |

(Continued)

FOREIGN PATENT DOCUMENTS

TW M299055 U 10/2006

*Primary Examiner* — Bryan R Muller

(74) *Attorney, Agent, or Firm* — Muncy, Geissler, Olds & Lowe, P.C.

(57) ABSTRACT

A fabrication method of a holding sleeve is provided. The holding sleeve is adapted to dispose around a body portion of a main body and can rotate relative to the body portion. A blocking member is disposed in at least one through hole of a first sleeve. A second sleeve is movable relative to and disposed around the first sleeve. The blocking member is controllably pressed by the second sleeve to be partially received in an annular groove of the body portion. An elastic member is disposed around and between the first sleeve the first and second sleeves. Before the second sleeve is mounted to the first sleeve, a part of the elastic member corresponds to the blocking member in a radial direction of the first sleeve and can limit the blocking member to locate in the through hole.

13 Claims, 11 Drawing Sheets

(56) References Cited

U.S. PATENT DOCUMENTS

| | | | | |
|---|---|---|---|---|
| 8,869,659 | B2 * | 10/2014 | Chang | B25B 13/00 81/177.1 |
| 2007/0214916 | A1 * | 9/2007 | Lee | B25B 23/0021 81/177.1 |

* cited by examiner

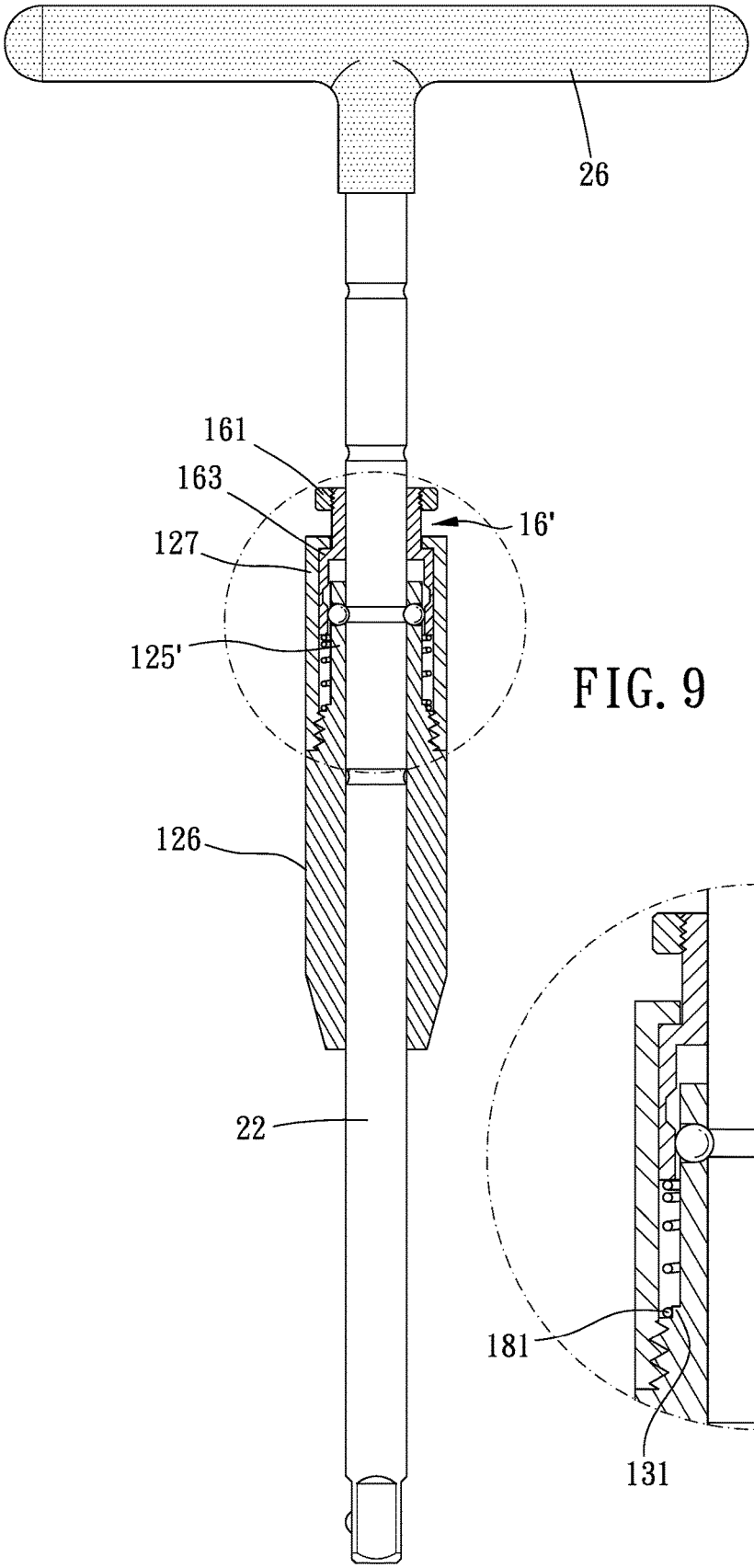
FIG. 9
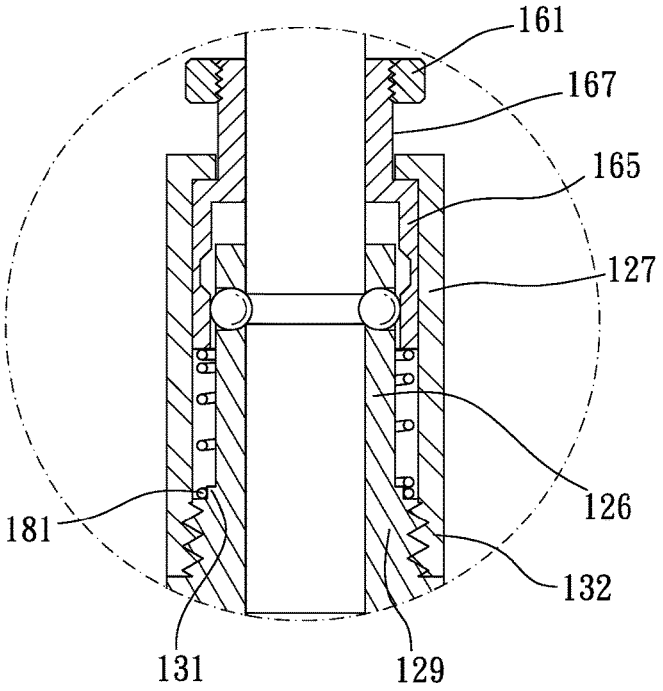

FABRICATION METHOD OF A HOLDING SLEEVE

FIELD OF THE INVENTION

The present invention is a CIP of application Ser. No. 14/806,396, filed Jul. 22, 2015, which is a CIP of application Ser. No. 13/630,061, filed Sep. 28, 2012, the entire contents of which are hereby incorporated by reference.

BACKGROUND OF THE INVENTION

Description of the Prior Art

Conventional connection members such as bolts or nuts are provided with various sizes according to various requirements, and thus wrenches are sized in sizes different from each other to fasten or unfasten the various bolts or nuts. To save storage space and reduce loading on a user due to the weights of the wrenches, a hand tool which includes an operation rod suitable to cooperate with variously sized sockets, such as a socket wrench, T-shaped wrench or Y-shaped wrench is developed. This kind of hand tool is generally includes an operation rod having an axial connection portion and sockets whose sizes are different from each other. Each of the sockets is formed with a receiving recess at one end thereof for correspondingly nonrotatably receive the axial connection portion of the operation rod, so that the user can rotate the operation rod together with the socket to fasten or unfasten the bolts or nuts.

A rapidly rotatable holding sleeve structure of a hand tool is disclosed in TW M299055 (application No.: 095204559). In TW M299055, a holding sleeve is disposing around the intermediate section of a handle, and a positioning pin is pivotally disposed in the holding sleeve. The positioning pin is fixedly secured to handle so that the handle is rotatable relative to the holding sleeve. Through the above structure, the user can use his one hand holding the holding sleeve and rotate the handle using the other hand during a later period of unfastening a bolt (or nut) or an earlier period of fastening a bolt (or nut), which can result in a convenient and smooth operation. However, there are problems with the above conventional structure when actually used: since the holding sleeve is relatively fixedly secured to the handle, the holding sleeve cannot be disassembled from the handle and thus cannot be interchanged to a handle of another kind; the holding sleeve cannot be adjusted in position relative to the handle, so that either of the holding sleeve and the handle has no interchangeability and adjustability; and the holding sleeve is difficult to fabricate, has plural parts and is of high cost.

US 20070214916 discloses that the spring member is much longer than the control ferrule. That is, when the spring member is disposed around the tubular member, the top end of the spring member is much outside the distal end of the tubular member before the control ferrule is connected with the tubular member. Besides, the spring member is provided with a coil pitch greater than the diameter of the detent at an intermediate portion thereof. Even the spring member is provided with reduced coil pitches at opposite ends, the top end of the spring member is still located beyond the distal end of the tubular member and cannot restrict the detent to remain within the orifice. As a result, the spring member cannot avoid disengagement of the detent from the orifice during fabrication of the control ferrule and the tubular member. Additionally, the retaining ring is attached to and entirely within the tubular member with such as a force-fitted engagement or by an adhesive material, such that the retaining ring cannot be manually detached by hand directly, thus being not easy to assemble/assemble, repair and replace elements.

US 20070214916 discloses only one single detent and only one single through hole receiving the detent. The coil spring extends spirally and has coil pitches each greater than the diameter of the detent. No portion of the coil spring can statically at least partially overlap the detent during assembling. The through hole needs to tilt relative to the ground or face upward for preventing disengagement of the detent from the through hole, before disposing the coil spring during assembling.

The present invention is, therefore, arisen to obviate or at least mitigate the above mentioned disadvantages.

SUMMARY OF THE INVENTION

An object of the present invention is to provide a fabrication method of a holding sleeve, in which the holding sleeve is easy and quick to assemble, disassemble and fabricate.

To achieve the above and other objects, a fabrication method of a holding sleeve is provided, including the following steps: providing a first sleeve which is substantially tubular and formed with at least one through hole and a stepped shoulder portion, wherein the at least one through hole is disposed between a distal end of the first sleeve and the stepped shoulder portion, the distal end is nearer the at least one through hole than the stepped shoulder portion; disposing at least one blocking member in the at least one through hole; disposing an elastic member around the first sleeve, wherein the elastic member is a coil spring, one end of the elastic member is abutted against the stepped shoulder portion of the first sleeve, without being depressed, an other end of the elastic member statically interferentially corresponds to the blocking member in a radial direction of the first sleeve so as to prevent disengagement of the at least one blocking member from the at least one through hole, and wherein as viewed in the radial direction of the first sleeve, without being depressed, two diametric portions of at least one coil of the coil spring statically at least partially overlap the at least one blocking member; and disposing a second sleeve around the first sleeve, wherein the elastic member is compressed between and abutted against the stepped shoulder portion and the second sleeve, the second sleeve is controllably movable relative to the first sleeve, and the at least one blocking member is abutted by the second sleeve so as to controllably partially go into the interior of the first sleeve.

The present invention will become more obvious from the following description when taken in connection with the accompanying drawings, which show, for purpose of illustrations only, the preferred embodiment(s) in accordance with the present invention.

BRIEF DESCRIPTION OF THE DRAWINGS

FIG. 9 is a cross-sectional view of according to an alternative embodiment the present invention.

DETAILED DESCRIPTION OF THE PREFERRED EMBODIMENTS

Figure 1:
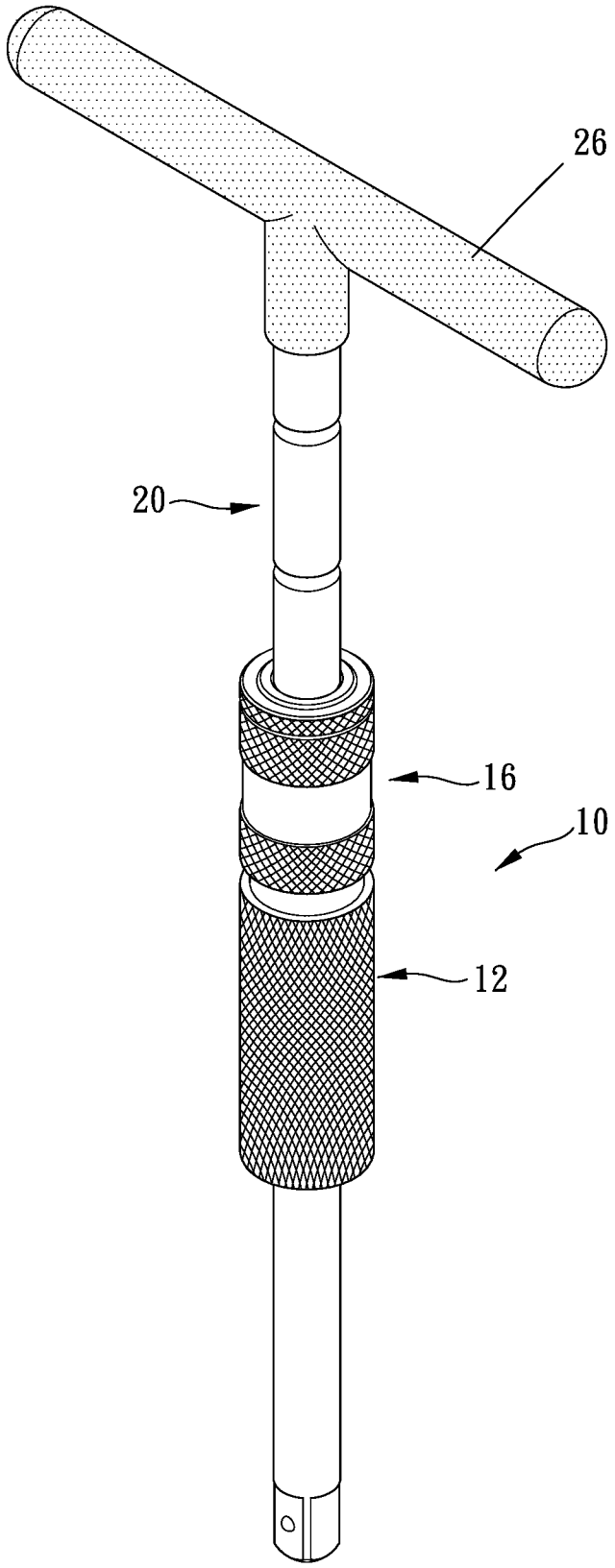
FIG. 1 is a perspective view of the present invention.

As shown in FIGS. 1 to 4, a retaining mechanism and a holding sleeve 10 having the same are provided. The retaining mechanism includes a first sleeve 12, at least one blocking member 14 and an elastic member 18. The first sleeve 12 is substantially tubular and formed with at least one through hole 122 and has a stepped shoulder portion 123. The at least one through hole 122 is disposed between a distal end 120 of the first sleeve 12 and the stepped shoulder portion 123. The at least one blocking member 14 is received in the at least one through hole 122. The elastic member 18 is disposed around a part 125 of the first sleeve 12. One end 181 of the elastic member 18 is abutted against the stepped shoulder portion 123 of the first sleeve 12, and the other end 182 of the elastic member 18 interferentially corresponds to the blocking member 14 in a radial direction of the first sleeve 12 so as to prevent disengagement of the blocking member 14 from the through hole 122 before the first sleeve 12 is connected with a second sleeve.

The holding sleeve 10 is adapted to be limitatively slidably disposed around a body portion 22 of a main body 20 and rotatable relative to the body portion 22. The body portion 22 of the main body 20 is formed with at least one annular groove 24, more specifically, formed with four annular grooves 24. However, the body portion 22 of the main body 20 may be formed with two, three or more than four annular grooves. The holding sleeve 10 includes a first sleeve 12, at least one blocking member 14, a second sleeve 16 and an elastic member 18.

The first sleeve 12 is substantially tubular and formed with at least one through hole 122, more specifically, formed with two corresponding through holes 122. However, the first sleeve 12 may be formed with one, three or more than four through holes. With the first sleeve 12 including the through holes 122, the through holes 122 are preferably evenly arranged around the first sleeve 12 with equal intervals therebetween. For each of the through holes 122, an inner opening at an inner surface of the first sleeve 12 is smaller than an outer opening at an outer surface of the first sleeve 12.

In this embodiment, the holding sleeve 10 includes two blocking members 14, and each of the blocking members 14 is received in one of the through holes 122. Preferably, each of the blocking members 14 is a ball-shaped body such as a rolling ball, steel ball or the like, and the amount of the blocking members 14 is equal to that of the through holes 122. The greatest external diameter of the blocking member 14 is smaller than the diameter of the outer opening but greater than the diameter of the inner opening of the through hole 122, such that the blocking member 14 is permitted to partially go into the interior of the first sleeve 12 via the inner opening but not go through the inner opening. The coil spring is moved, vertically toward the ground, to be sleeved around the first sleeve 12 which is vertical to the ground.

The second sleeve 16 is movable relative to the first sleeve 12 and disposed around the part 125 of the first sleeve 12 and depressing the other end 182 of the elastic member 18. The elastic member 18 is located between the second sleeve 16 and stepped shoulder portion 123. The blocking members 14 are abutted by the second sleeve 16 so as to be controllably partially received in the annular groove 24 to secure the holding sleeve 10 and the main body 20. In this embodiment, the second sleeve 16 includes an annular member 162 and a tubular member 164. The annular member 162 is detachably secured to the distal end 120 of the first sleeve 12, and the tubular member 164 is slidably disposed between the annular member 162 and the stepped shoulder portion 123 of the first sleeve 12. The annular member 162 is threadedly connected with the distal end 120 of the first sleeve 12 and located out side the tubular member 164. The annular member 162 is located beyond an end surface of the tubular member 164 and detachable from an outside of the tubular member 164, so that the annular member 162 can be manually detached by hand directly. More specifically, the inner circumferential surface of the annular member 162 is formed with inner threads, the top end of the first sleeve 12 is formed with outer threads, and the annular member 162 and the first sleeve 12 are screwed together via the inner threads and the outer threads. However, the annular member 162 and the first sleeve 12 are not limited to be connected with each other via the above screwing manner.

In this embodiment, the inner surface of the tubular member 164 of the second sleeve 16 is formed with a circumferential projection 166 and a circumferential indentation 168 adjacent thereto, and the tubular member 164 of the second sleeve 16 is movable between a limitation position and a release position relative to the first sleeve 12. When the tubular member 164 of the second sleeve 16 is located in the limitation position, the circumferential projection 166 abuts against the blocking members 14 so that each of the blocking members 14 is partially received in the annular groove 24. When the tubular member 164 of the second sleeve 16 is located in the release position, the circumferential indentation 168 corresponds to the blocking members 14 so that the blocking members 14 go into the circumferential indentation 168 and are non-wedged in the annular groove 24.

As shown in FIGS. 1 to 4, the elastic member 18 is disposed around the first sleeve 12 and abutted against the first sleeve 12 and the second sleeve 16. More specifically, the elastic member 18 is abutted between the tubular member 164 and the first sleeve 12. In this embodiment, the elastic member 18 is a coil spring, in which the coil spring is provided with a relatively smaller coil pitch at at least one end of the coil spring and with a relative greater coil pitch at an intermediate portion of the coil spring, wherein the coil pitch is defined as a distance between two adjacent winds of the coil spring, such that the coil spring can include less winds of coil. That is, the coil spring can have a smaller lengthwise length after compressed, thus the used material of the coil spring can be reduced and the holding sleeve 10 can be made with a smaller size in length. The coil pitch at the other end 182 of the elastic member 18 is smaller than a diameter of the blocking member 14. It can be understood that, in an alternative embodiment, each coil pitch of the coil spring may be smaller than an extent of the blocking member 14 extending in an axial direction of the first sleeve 12 (for example, the diameter of a ball-shaped body). As such, no matter the disposed location of the coil spring relative to the first sleeve 12 is, every two adjacent winds of the coil spring can abut the blocking members 14, so as to prevent disengagement of the blocking members 14 from the through holes 122 during the process of disposing the second sleeve 16 around the first sleeve 12. Specifically, a length L1 of the elastic member 18 in a direction from the stepped shoulder portion 123 toward the distal end 120 of the first sleeve 12 is smaller than a distance L2 from the stepped shoulder portion 123 to a top point P1 of the blocking member 14. As viewed in a radial direction of the first sleeve 12, without being depressed, two diametric portions 183 of one coil of the coil spring statically at least partially overlap the at least one blocking member 14. Endmost two coils of the coil spring define the relatively smaller coil pitch, and one of the endmost two coils includes the two diametric portions; or, an outmost one of the endmost two coils includes the two diametric portions. It is noted that one of the two blocking members can disengage from the through hole during assembling if the first sleeve is tilted relative to the ground, and it cannot retain the two blocking members at the same time. Since at least outmost one of the endmost two coils includes the two diametric portions and since the coil spring is moved, vertically toward the ground, to be sleeved around the first sleeve 12 which is vertical to the ground, disengagement of the two blocking members from the two through hole are effectively prevented.

Figure 4:
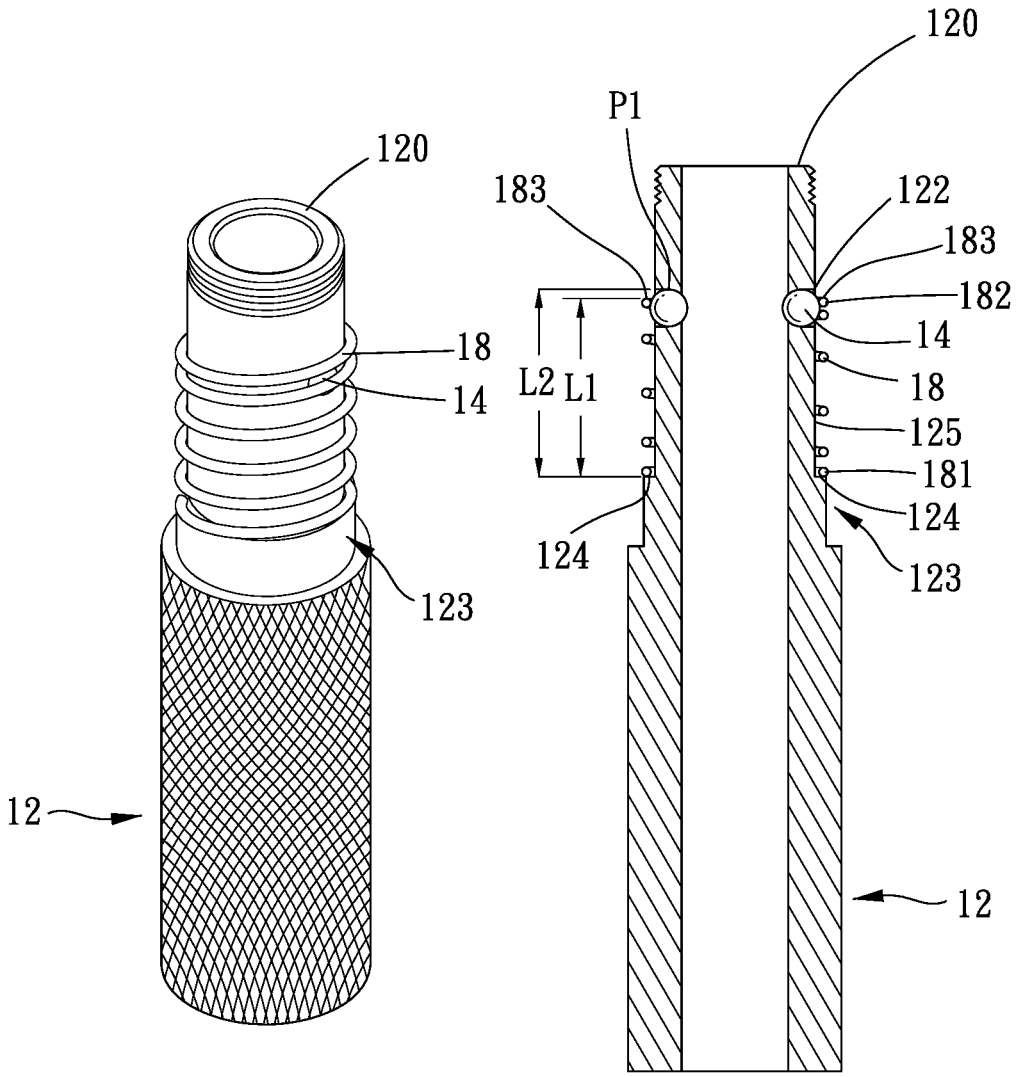
FIG. 4 is a partial view of the present invention.
Figure 4A:
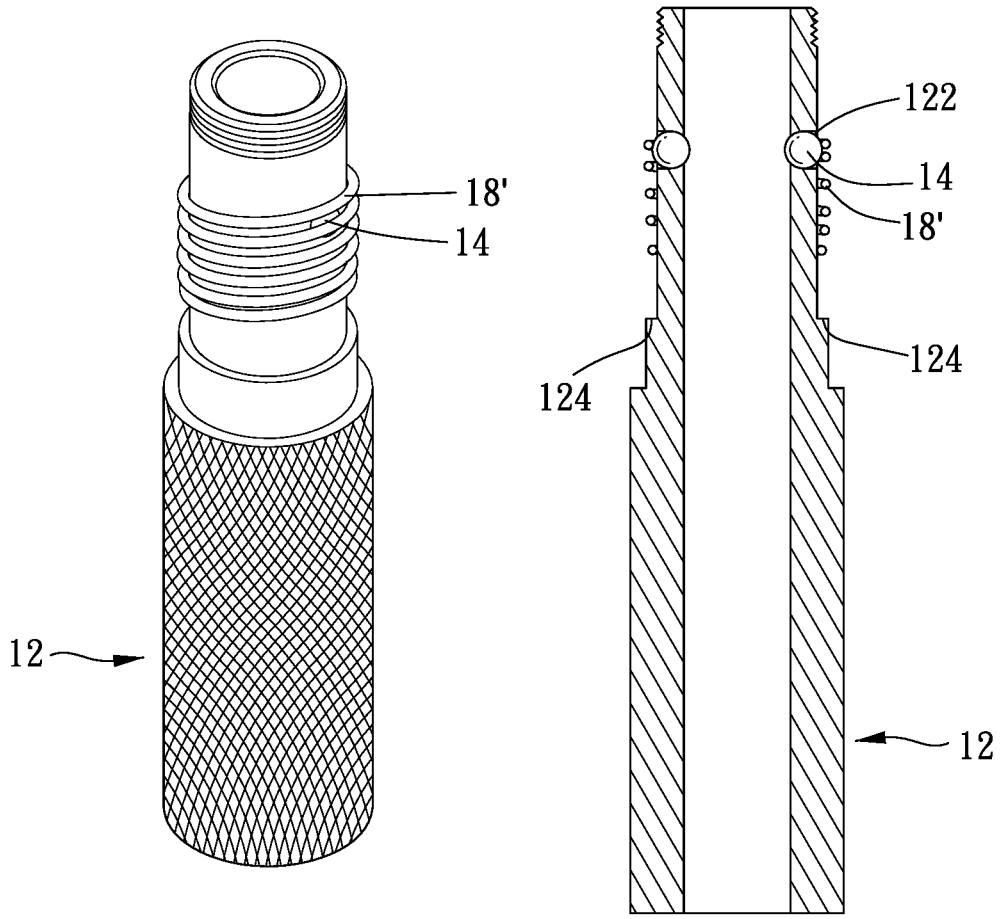
FIG. 4A is a partial view according to an alternative embodiment of the present invention.
Figure 4B:
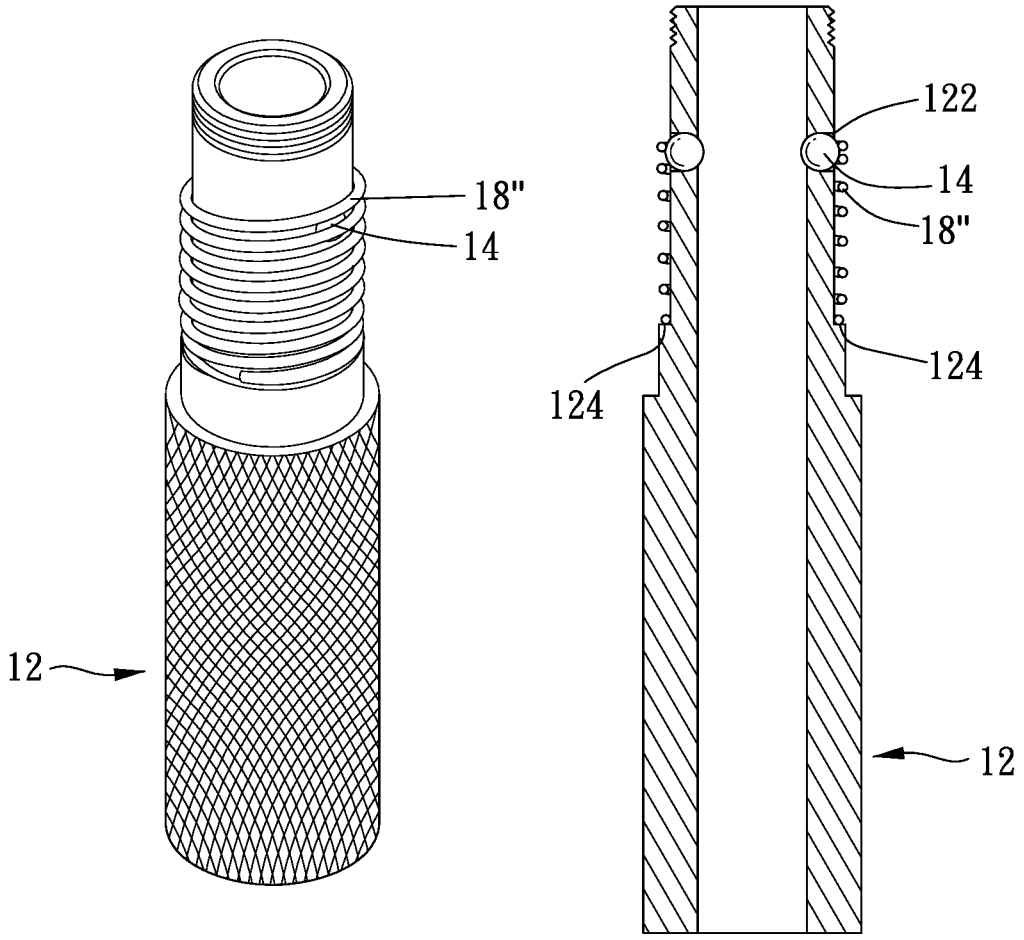
FIG. 4B is a partial view according to another embodiment of the present invention.

It should be noted that the elastic member may be designed to have a different structure, as shown in FIG. 4A, for example, a lengthwise extent of an elastic member 18' is smaller than a distance between the through holes 122 and an annular abutting surface 124 of the first sleeve 12. After the blocking members 14 are received in the through holes 122, the internal diameter of the elastic member 18' is slightly smaller than the greatest distance between two corresponding blocking members 14 in a radial direction of the first sleeve 12. As such, the elastic member 18' can steadily abut the blocking members 14 so as to prevent disengagement of the blocking members 14 from the through holes 122. It is noted that an elastic member 18" may be abutted against the stepped shoulder portion 123 of a first sleeve 12, and every two adjacent coils of the elastic member (coil spring) 18" are provided with a coil pitch smaller than the diameter of the blocking member 14 (shown in FIG. 4B).

Figure 3:
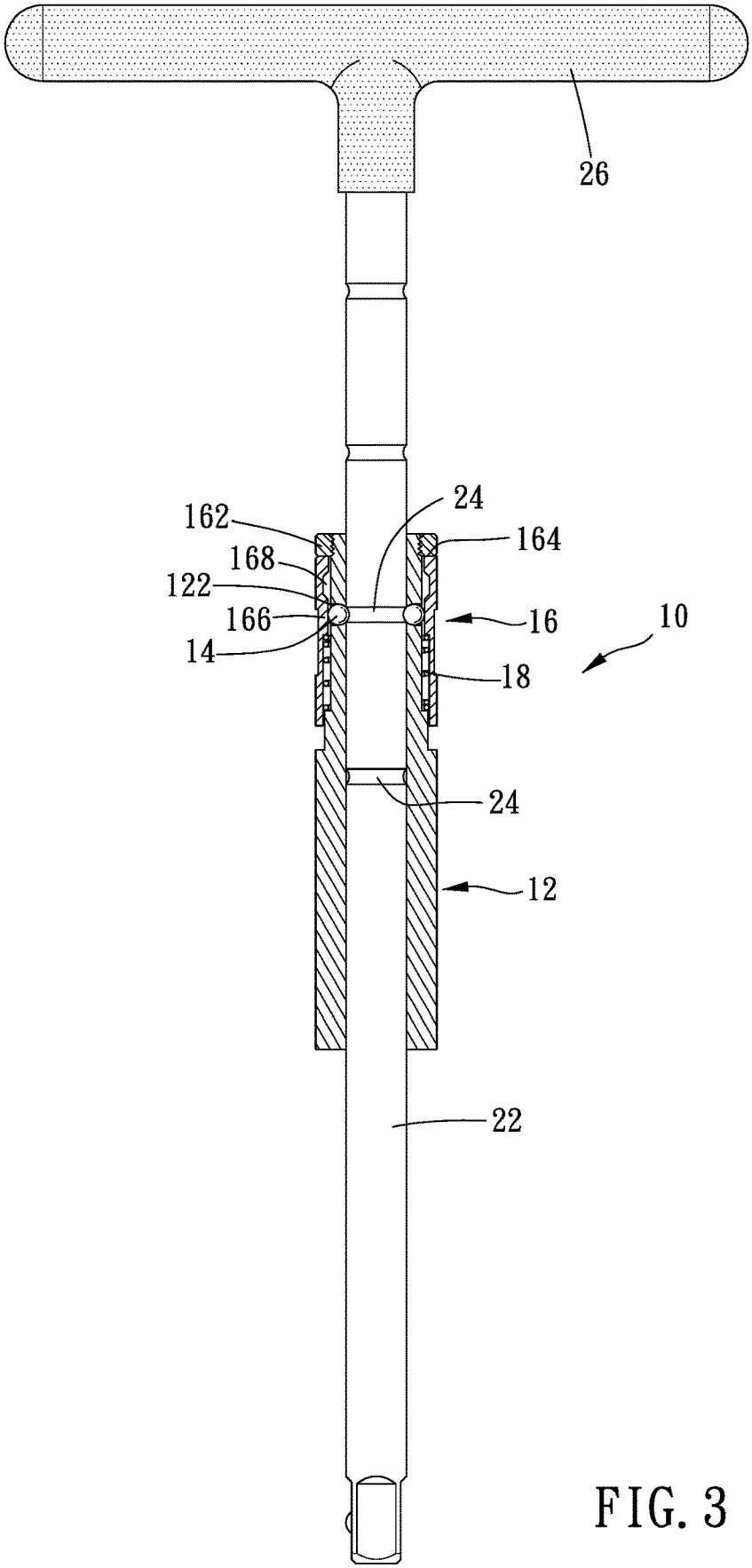
FIG. 3 is a cross-sectional view of the present invention.

As shown in FIGS. 3 and 4, in fabrication, the elastic member 18 is disposed around the first sleeve 12 in advance. Before the second sleeve 16 and the first sleeve 12 are connected with each other, one bottom end of the elastic member 18 is preferably abutted against the annular abutting surface 124 of the first sleeve 12, and a part of the elastic member 18 corresponds to the blocking members 14 in a radial direction of the first sleeve 12. More specifically, a top end having a relative smaller coil pitch of the coil spring is disposed around the blocking members 14, so as to prevent disengagement of the blocking members 14 from the through holes 122, thus facilitating following fabrication process. Preferably, the coil spring can be rotated around the first sleeve 12 by any angle (0-360°) and the elastic member 18 can always be kept with a part corresponding to the blocking members 14 in the radial direction of the first sleeve 12 so as to limit movement of the blocking members 14.

The second sleeve 16 is then disposed around the first sleeve 12. Since the radial extent of the circumferential projection 166 of the tubular member 164 is smaller than the external diameter of the coil spring, the coil spring can be compressed by the circumferential indentation 168 of the tubular member 164 so as to assist in biasing of the second sleeve 16 away from the first sleeve 12. When the circumferential projection 166 of the tubular member 164 keeps compressing the coil spring until a top end of the first sleeve 12 is exposed outside the tubular member 164, the annular member 162 is then secured to the top end of the first sleeve 12 so as to retain the tubular member 164 to be located between the annular member 162 and the annular abutting surface of the first sleeve 12 so that the tubular member 164 cannot disengage from the first sleeve 12. The circumferential projection 166 has annular flat face 169, and as viewed in the radial direction of the first sleeve 12, the annular flat face 169 is diametrically extends beyond the at least one through hole 122 and completely covers the at least one through hole 122 in an axial direction of the first sleeve 12 when the second sleeve 16 is located in the limitation position. Preferably, the annular flat face 169 is at least 1.2 times wider than the through hole 122 in the axial direction of the first sleeve 12. As a result, the circumferential projection 166 can smoothly slide on the blocking member 14 and does not get stuck by the blocking member 14; there forms no entrance between the circumferential projection 166 and the through hole 122 so that the elastic member 18 cannot get stuck thereinto; and the first sleeve 12 and the second sleeve 16 can relatively slide smoothly and stably.

It is noted that, when the elastic member 18' as shown in FIG. 4A is used, since the internal diameter of the elastic member 18' is slightly smaller than the greatest distance between two corresponding blocking members 14 in the radial direction of the first sleeve 12. As such, in fabrication, the elastic member 18' may be selectively disposed around the first sleeve 12 in advance (for example, the elastic member 18' is butted against the annular abutting surface 124 of the first sleeve 12), the blocking members 14 are disposed in the through holes 122, and the elastic member 18' is then moved upwardly to limit the blocking members 14 between two adjacent winds of coil of the elastic member 18', so that the elastic member 18' can effectively abut the blocking members 14. The second sleeve 16 is disposed around the first sleeve 12; alternatively, the blocking members 14 may be selectively disposed in the through holes 122 in advance, the elastic member 18' is then disposed around the first sleeve 12, and the blocking members 14 are retained between two adjacent winds of coil of the elastic member 18'. As such, the elastic member 18' can also effectively abut against the blocking members 14. Finally, the second sleeve 16 is disposed around the first sleeve 12.

Regarding the fabrication method of the holding sleeve 10 is further described below. The fabrication method of the holding sleeve 10 includes following steps: providing the first sleeve 12 which is substantially tubular and formed with the through holes 122; disposing the blocking members 14 in the through holes 122; disposing the elastic member 18 around the first sleeve 12, wherein a part of the elastic member 18 corresponds to the blocking member 14 in the radial direction of the first sleeve 12 so as to prevent disengagement of the blocking member 14 from the through holes 122; and disposing the second sleeve 16 around the first sleeve 12, wherein the elastic member 18 is compressed and abutted against the first sleeve 12 and the second sleeve 16, the second sleeve 16 is controllably movable relative to the first sleeve 12, and the blocking members 14 are abutted by the second sleeve 16 so as to controllably partially go into the interior of the first sleeve 12.

Figure 5:
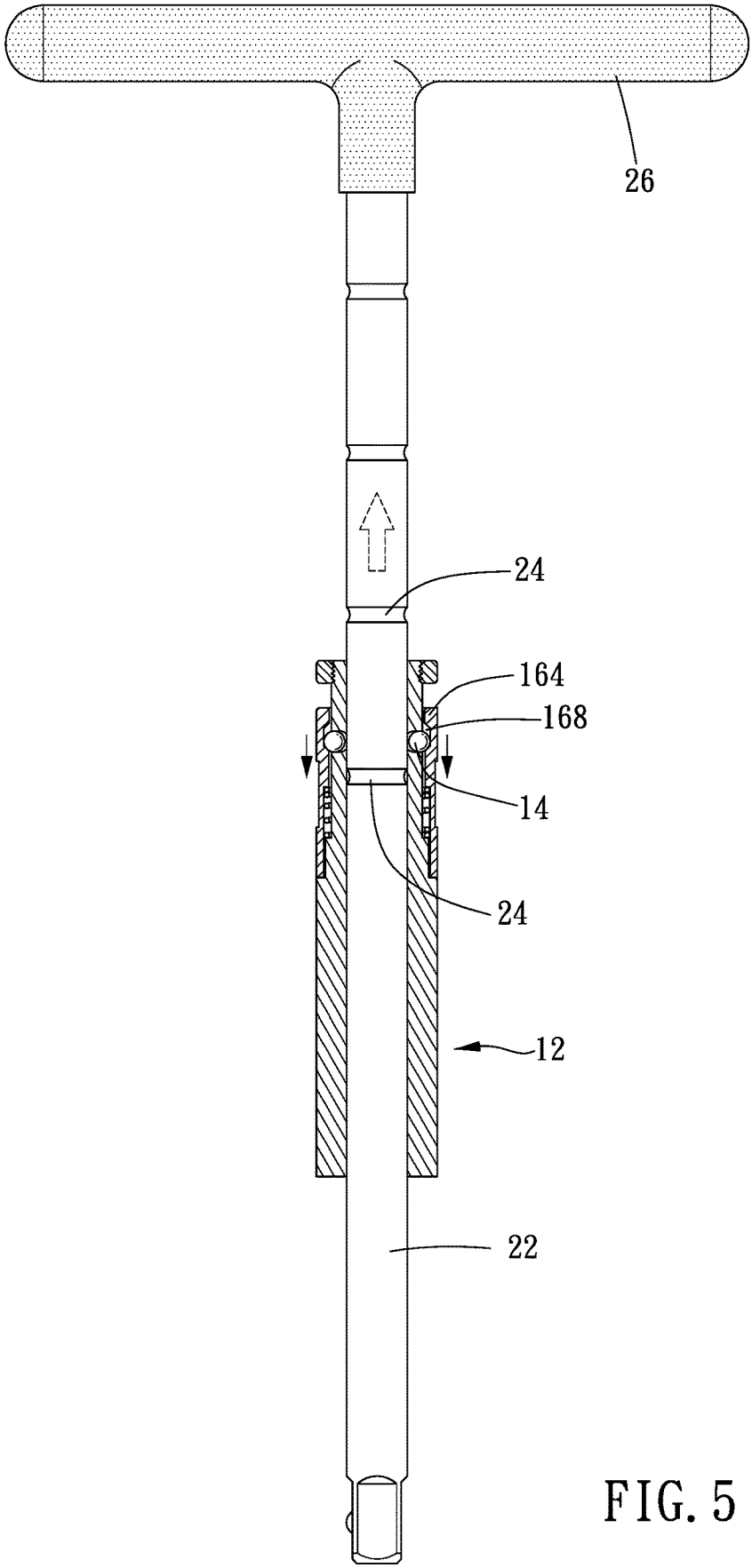
FIGS. 5 and 6 are views showing an use of the present invention.
Figure 6:
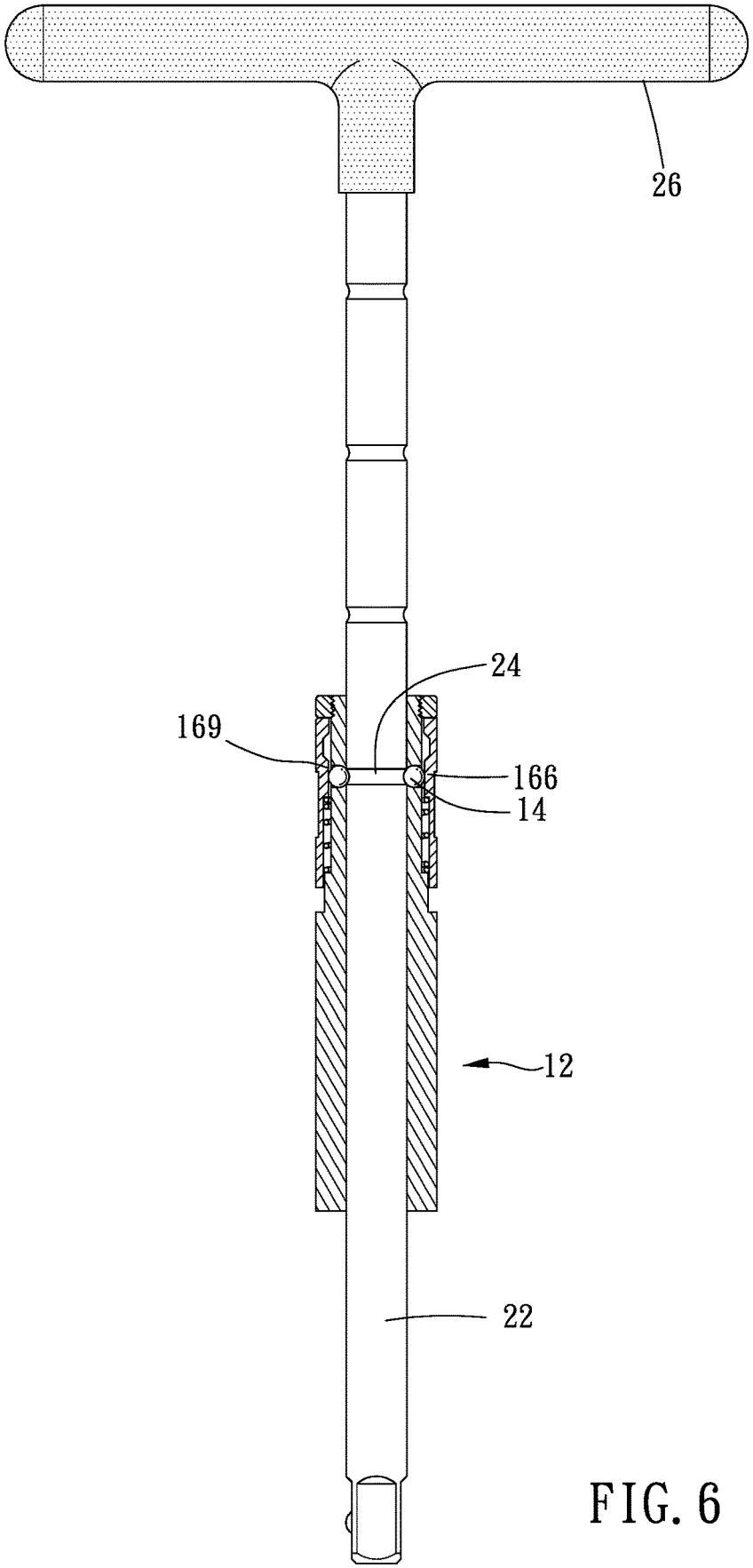

As shown in FIGS. 3, 5 and 6, in use, when the second sleeve 16 is located in the limitation position, the circumferential projection 166 is abutted against the blocking members 14 so that the blocking members 14 are partially received in one of the annular grooves 24, so as to block the holding sleeve 10 at the body portion 22 of the main body 20 (FIG. 3); when the tubular member 164 moves toward the annular abutting surface of the first sleeve 12 to the release position, that is, the circumferential indentation 168 of the tubular member 164 corresponds to the blocking members 14 (FIG. 5), the circumferential indentation 168 permits the blocking members 14 to go thereinto so that the blocking members 14 are not hustled to be received in the annular groove 24. More specifically, the blocking members 14 blocked in the annular groove 24 of the body portion 22 is radially outwardly pushed by the body portion 22 to move into the circumferential indentation 168, so that the holding sleeve 10 is no longer blocked and can thus slide relative to the body portion 22, whereby being capable of changing the limited position of the holding sleeve 10 relative to the body portion 22 (FIG. 6).

Figure 2:
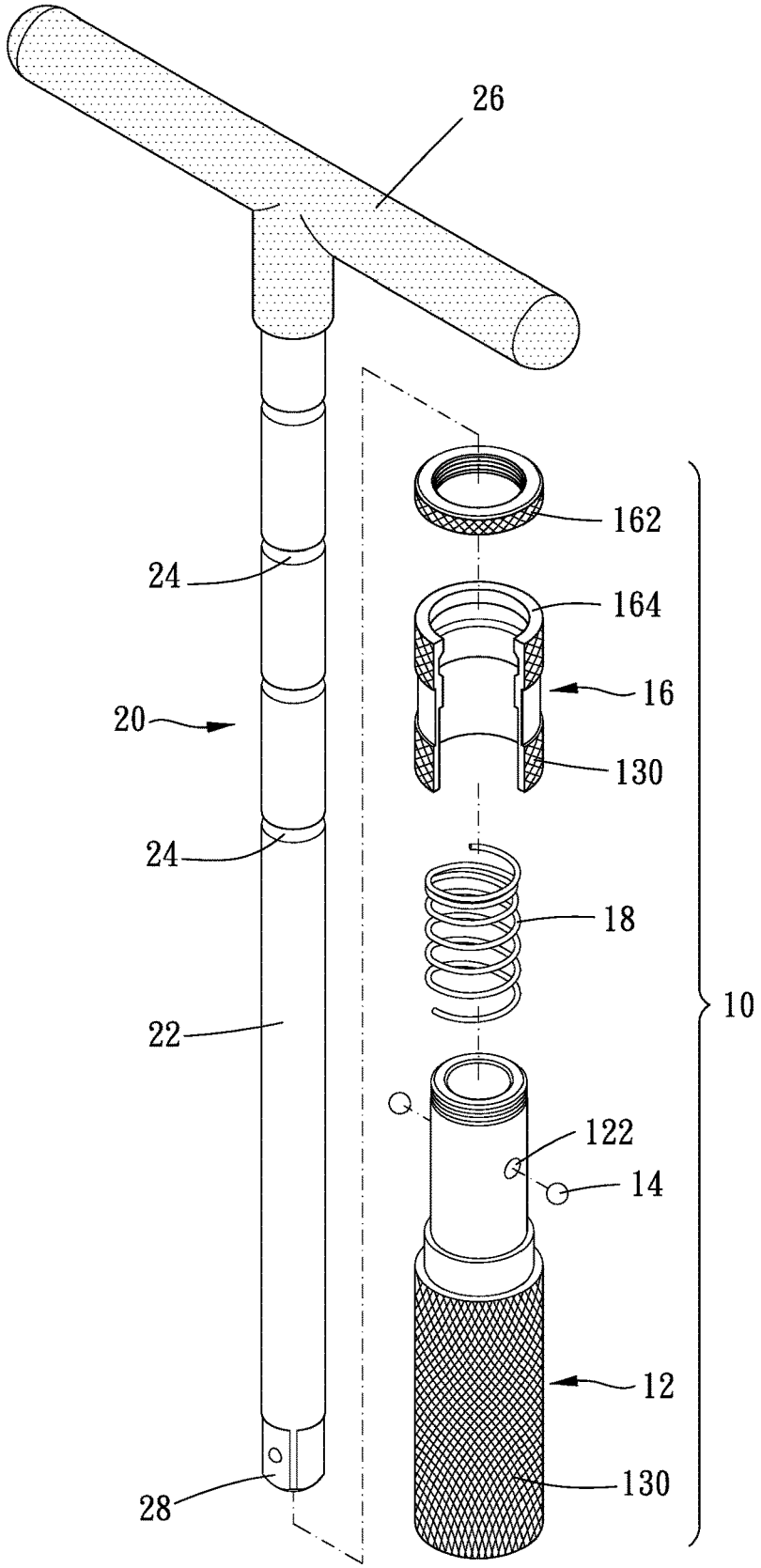
FIG. 2 is a perspective breakdown view of the present invention.

It is noted that, as shown in FIG. 2, to improve the grip effects on the holding sleeve 10, at least one of the first sleeve 12 and the second sleeve 16 has a rugged pattern 130 partially formed on their respective outer surfaces. More specifically, either of the outer surfaces of the first sleeve 12 and the second sleeve 16 is preferably formed with the rugged pattern 130, so as to avoid the problem of being hard to grip the holding sleeve 10 due to a smooth outer surface.

As shown in FIGS. 1-3 and 5, a rod tool is provided with a holding sleeve 10 and a main body 20. In this embodiment, the holding sleeve 10 and the main body 20 are exemplary and are not limited thereto.

In this embodiment, the holding sleeve 10 is limitatively slidably disposed around the body portion 22 and rotatable relative to the body portion 22. When the second sleeve 16 is located in the limitation position (FIG. 3), the blocking members 14 are abutted by the second sleeve 16 and controllably partially received in the annular groove 24, so as to secure the holding sleeve 10 to the body portion 22. Alternatively, the second sleeve 16 may be selectively slid relative to the first sleeve 12 to adjust the second sleeve 16 to be located in the release position (FIG. 5), and thus the holding sleeve 10 can be slid relative to the body portion 22 of the main body 20, whereby being capable of changing the limited position of the holding sleeve 10 relative to the body portion 22 or permitting the removal of the holding sleeve 10 from the body portion 22 of the main body 20.

Regarding the fabrication method of the rod tool is further described below. In the fabrication method of the rod tool, the fabricated holding sleeve 10 is disposed around the body portion 22 of the main body 20, that is, the main body 20 is disposed through the first sleeve 12 and the second sleeve 16, the second sleeve 16 is movable and can controllably move relative to the first sleeve 12 to abut the blocking members 14, so that the blocking members 14 are hustled and partially received in the annular groove 24. Whereby, the holding sleeve 10 is secured to the body portion 22 and rotatable relative to the body portion 22. The fabrication method of the holding sleeve 10 is well described previously and thus not described herein in detail.

Besides, the structures, functions, effects, the cooperative relationship and the fabrication methods of the holding sleeve 10 and the main body 20 are also well described previously and thus not described herein in detail.

A user can connect the fabricated rod tool to a wrench or other working member via the joint, to rapidly rotate the rod tool to screw or unscrew a fastener such as a nut, for example. More specifically, the user can hold the holding sleeve 10 with one of his hands and rotate the main body 20 with the other hand, so that the fastener to be screwed or unscrewed can be rapidly fastened or unfastened.

Figure 7:
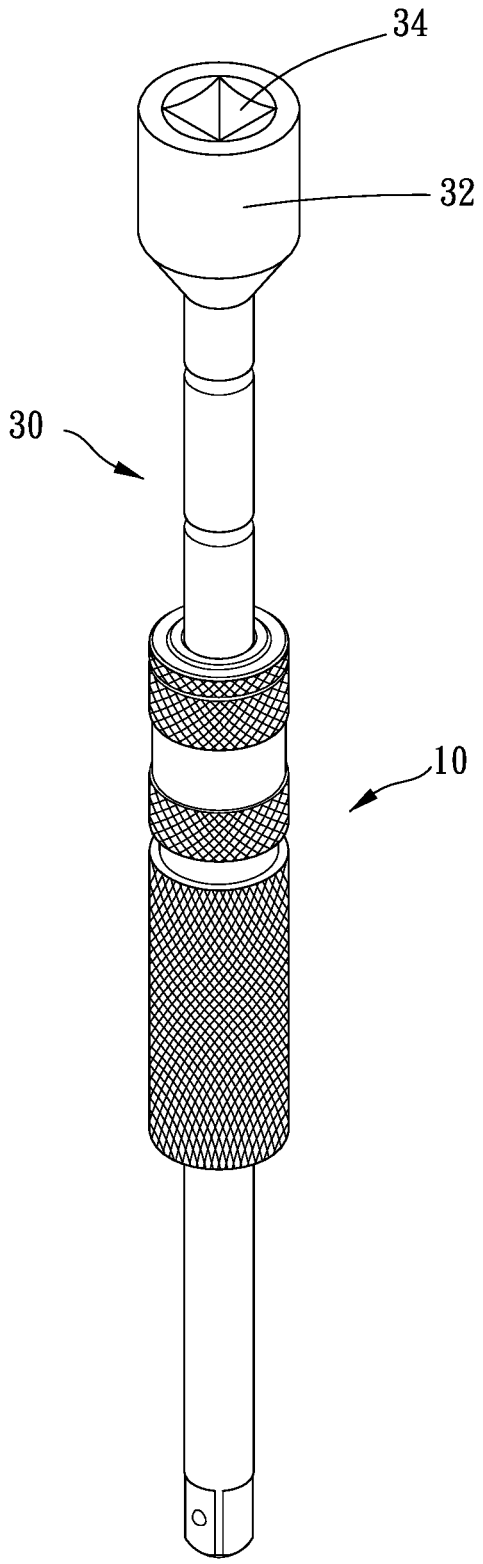
FIG. 7 is a perspective view according to an alternative embodiment of the present invention

Additionally, the structure of the main body 20 can be modified on the basis of the spirit of the invention. For example, the main body 20 may include two end portions respectively disposed at two ends of the body portion 22, and the two end portions may be respectively formed with a driving portion 26 and a joint 28. The driving portion 26 may be a transverse rod which is substantially perpendicularly connected to the body portion 22, and the driving portion 26 and the body portion 22 substantially forms an T-shaped structure (as shown in FIG. 2). Alternatively, in a preferable embodiment as shown in FIG. 7, a driving portion of a main body 30 may be a joint 32 formed with a receiving recess 34, the joint 32 can be adapted to be connected to a driving device such as a pneumatic or electric rotating driving device, manually-driving device or the like. However, the joint 32 can be adapted to be connected to another rod member so as to elongate the rod tool, thus being much utility and expansive.

Figure 8:
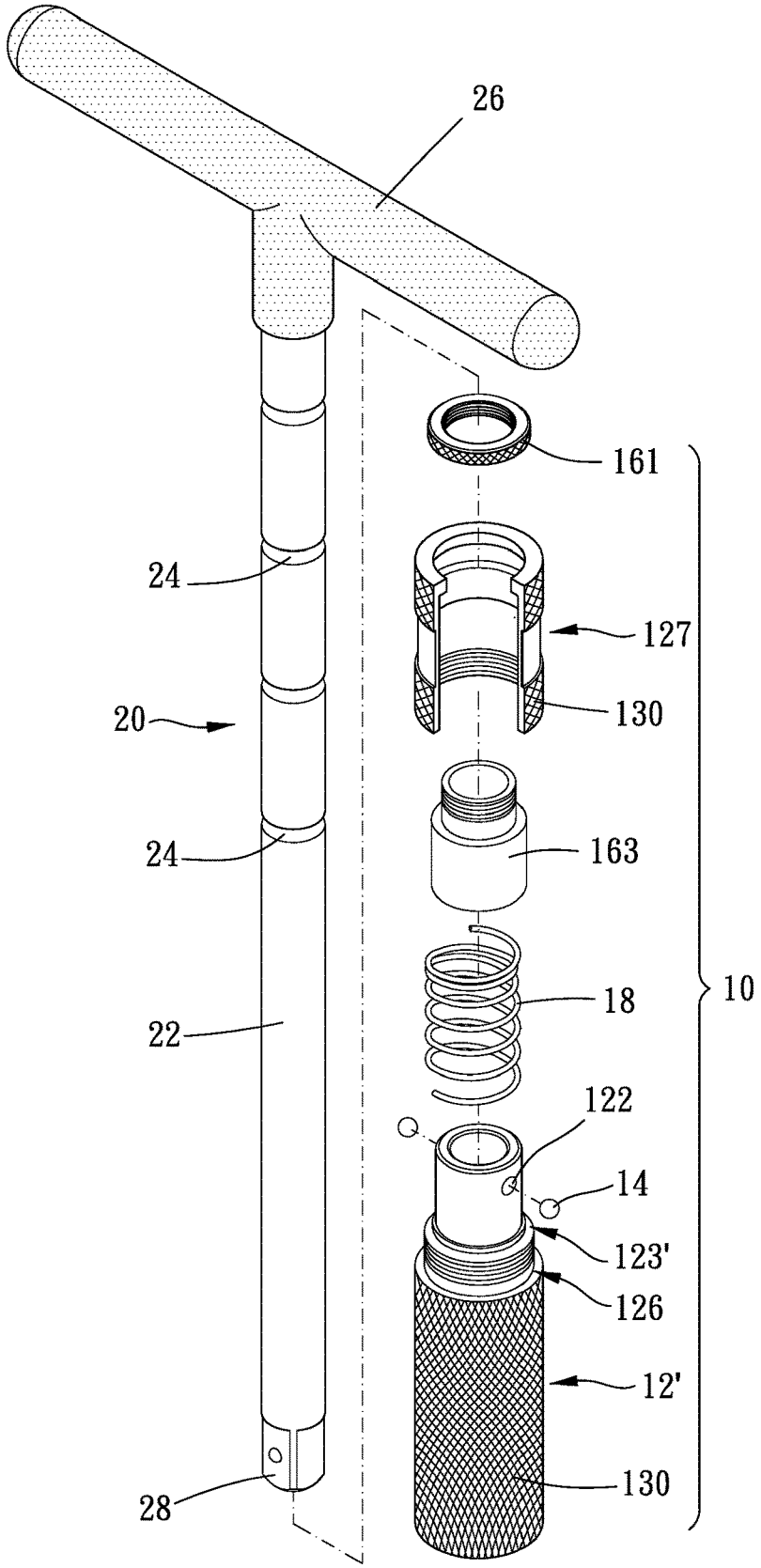
FIG. 8 is a perspective breakdown view according to an alternative embodiment of the present invention.

In an alternative embodiment, as shown in FIGS. 8 and 9, a stepped shoulder portion 123' includes a flange 131 received within the end 181 of the elastic member 18 which is abutted against the stepped shoulder portion 123'. The first sleeve 12' includes a main tubular member 126 which has the at least one through hole 122 and the stepped shoulder portion 123' and a cap tubular member 127 which is detachably connected with the main tubular member 126. Specifically, the stepped shoulder portion 123' is provided with an outer threaded section 129, the cap tubular member 127 is provided with an inner threaded section 132 threadedly connected with the outer threaded section 129. The second sleeve 16' includes an annular member 161 and a tubular member 163. The tubular member 163 is formed with a large-diameter section 165 and small-diameter section 167. The large-diameter section 165 is limitatively sleeved within the cap tubular member 127 and movably disposed on the main tubular member 126 and around the part 125' of the first sleeve 12'. The elastic member 18 is located between the large-diameter section 165 and stepped shoulder portion 123' of the first sleeve 12'. The small-diameter section 167 projects out of the cap tubular member 127, and the annular member 161 is detachably secured to a distal end of the small-diameter section 167 outside the cap tubular member 127, so that the annular member 161 can be manually detached by hand directly. The elastic member 18 is abutted between the tubular member 163 and the stepped shoulder portion 123' of the first sleeve 12'. The stepped shoulder portion 123' includes a flange 131 received within the end 181 of the elastic member 18 which is abutted against the stepped shoulder portion 123', so that the elastic member 18 can be stably assembled.

In sum, via simply disposing the elastic member around the first sleeve, a part of the elastic member corresponds to the blocking members in a radial direction of the first sleeve so as to prevent disengagement of the blocking members from the through holes, and elements can be easily and quickly assembled.

Furthermore, the annular member of the second sleeve is detachably secured to the top end of the first sleeve, so that the blocking members and the elastic member can be easily and quickly assembled or disassembled, and the first sleeve and the second sleeve can be easily and quickly assembled or disassembled.

The distal end is nearer the at least one through hole than the stepped shoulder portion, without being depressed, the other end of the elastic member statically interferentially corresponds to the blocking member in a radial direction of the first sleeve, and as viewed in a radial direction of the first sleeve, without being depressed, two diametric portions of one coil of the coil spring statically at least partially overlap the at least one blocking member. One end of the coil spring is statically abutted against the stepped shoulder portion, so that the other end of the coil spring can statically interferentially correspond to the blocking member in a radial direction; in the meantime, the distal end is nearer the at least one through hole, which allows the elastic member with sufficiently length for providing sufficient elastic force for recovery. It is easy to install the blocking member.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A fabrication method of a holding sleeve, including the following sequential steps:

providing a first sleeve which is substantially tubular and formed with at least one through hole and a stepped shoulder portion, wherein the at least one through hole is disposed between a distal end of the first sleeve and the stepped shoulder portion, the distal end is nearer the at least one through hole than the stepped shoulder portion;

disposing at least one blocking member in each of the at least one through hole;

disposing an elastic member around the first sleeve, wherein the elastic member is a coil spring, one end of the elastic member is abutted against the stepped shoulder portion of the first sleeve, without being depressed, while an other end of the elastic member statically interferentially corresponds to the blocking member in a radial direction of the first sleeve so as to prevent disengagement of the at least one blocking member from the at least one through hole, and wherein as viewed in the radial direction of the first sleeve, without being depressed, two diametric portions of adjacent endmost coils of the coil spring statically at least partially overlap the at least one blocking member; and disposing a second sleeve around the first sleeve, wherein the elastic member is compressed between and abutted against the stepped shoulder portion and the second sleeve, the second sleeve is controllably movable relative to the first sleeve, and the at least one blocking member is abutted by the second sleeve so as to control movement of the at least one blocking member within the respective at least one through hole.

2. The fabrication method of claim 1, wherein the elastic member is provided with a relatively smaller coil pitch at the other end thereof corresponding to the at least one blocking member and with a relatively greater coil pitch at an intermediate portion thereof, the coil pitch is defined as a distance between two adjacent coils of the coil spring, and endmost two coils of the coil spring define the relatively smaller coil pitch, the endmost two coils includes the two diametric portions, and without being depressed, the two diametric portions statically interferentially correspond to the blocking member in the radial direction of the first sleeve.

3. The fabrication method of claim 2, wherein the first sleeve includes two of said through holes disposed diametrically thereon, and each of the two of said through holes receives one of said blocking members.

4. The fabrication method of claim 3, wherein the coil spring is moved, vertically toward the ground, to be sleeved around the first sleeve which is vertical to the ground.

5. The fabrication method of claim 2, wherein the relatively smaller coil pitch at the other end of the elastic member is smaller than a diameter of the blocking member, and an outmost one of the endmost two coils includes the two diametric portions.

6. The fabrication method of claim 5, wherein the first sleeve includes two of said through holes disposed diametrically thereon, and each of the two of said through holes receives one of said blocking members.

7. The fabrication method of claim 6, wherein the coil spring is moved, vertically toward the ground, to be sleeved around the first sleeve which is vertical to the ground.

8. The fabrication method of claim 1, wherein an inner surface of the second sleeve is formed with a circumferential projection and a circumferential indentation adjacent to each other, the second sleeve is movable between a limitation position and a release position relative to the first sleeve, when the second sleeve is located in the limitation position, the circumferential projection abuts the at least one blocking member so that the at least one blocking member moves radially toward the interior of the first sleeve.

9. The fabrication method of claim 8, wherein the circumferential projection has annular flat face, and as viewed in the radial direction of the first sleeve, the annular flat face is diametrically extends beyond the at least one through hole and completely covers the at least one through hole in an axial direction of the first sleeve when the second sleeve is located in the limitation position.

10. The fabrication method of claim 9, wherein the annular flat face is at least 1.2 times wider than the through hole in the axial direction of the first sleeve.

11. The fabrication method of claim 1, wherein at least one of the first sleeve and the second sleeve has a rugged pattern partially formed on their outer surfaces.

12. The fabrication method of claim 1, wherein a length of the elastic member in a direction from the stepped shoulder portion toward the distal end of the first sleeve is smaller than a distance from the stepped shoulder portion to a top point of the blocking member.

13. The fabrication method of claim 1, wherein a number of the coils of the coil spring is equal to or greater than 4.

* * * * *